United States Patent [19]

Ludwig et al.

[11] Patent Number: 4,463,833

[45] Date of Patent: Aug. 7, 1984

[54] ELEVATOR SYSTEM

[75] Inventors: Richard H. Ludwig, West Caldwell; Linus R. Dirnberger, Randolph; Alan L. Husson, Hackettstown, all of N.J.

[73] Assignee: Westinghouse Electric Corp., Pittsburgh, Pa.

[21] Appl. No.: 409,687

[22] Filed: Aug. 19, 1982

[51] Int. Cl.[3] ..... B66B 3/02

[52] U.S. Cl. ..... 187/29 R; 340/19 R; 340/20; 340/21

[58] Field of Search ..... 187/29, 29 R

[56] References Cited

U.S. PATENT DOCUMENTS

| | | | |
|---|---|---|---|
| 3,747,710 | 7/1973 | Winkler | 187/29 R |
| 3,898,611 | 8/1975 | Mandel | 340/19 R |
| 3,995,719 | 12/1976 | Mandel et al. | 340/19 R X |
| 4,032,882 | 6/1977 | Mandel et al. | 340/19 R |
| 4,102,437 | 7/1978 | Mandel | 340/21 X |
| 4,248,327 | 2/1981 | Mandel et al. | 187/29 R |
| 4,256,203 | 3/1981 | Masel | 187/29 R |
| 4,317,506 | 3/1982 | Quan et al. | 187/29 R |
| 4,367,811 | 1/1983 | Yoneda et al. | 187/29 R |
| 4,387,436 | 6/1983 | Katayama et al. | 187/29 R X |
| 4,389,631 | 6/1983 | Kajiyama et al. | 187/29 R X |

*Primary Examiner*—G. Z. Rubinson
*Assistant Examiner*—Paul Shik Luen Ip
*Attorney, Agent, or Firm*—D. R. Lackey

[57] ABSTRACT

An elevator system in which a count is maintained to enable a car to be leveled in the correct travel direction in the event the car stops outside the landing zone of a target floor. The count is incremented each time the advanced car position changes floors, and it is decremented each time the car is level with a floor during the run. If the car lands outside the landing zone, a zero count indicates the car overshot the floor, while a non-zero count indicates undershoot. The count, along with the travel direction of the run, which is stored in memory, thus determines the leveling direction to level the car with the target floor.

7 Claims, 9 Drawing Figures

ELEVATOR SYSTEM

BACKGROUND OF THE INVENTION

1. Field of the Invention

The invention relates in general to elevator systems, and more specifically to new and improved apparatus and methods for determining the proper direction to a target floor when an elevator car overshoots or undershoots the floor and stops outside the normal landing zone.

2. Description of the Prior Art

An elevator car, when stopping at a floor, usually stops within a predetermined landing zone. Once the car is within this zone, it will stop within about 0.25 inch of floor level, and any stretch-of-rope releveling required will automatically take place, to maintain the desired level position. Hatch transducers, leveling switches, and the like, are used to establish the proper car travel direction when car movement or releveling is necessary within the landing zone.

If an elevator car overshoots or undershoots the landing zone of a target floor, for some reason, such as due to an error in the position transducer which maintains car position, the floor selector will indicate that the car is at the floor. Unless the elevator system is of the type which maintains absolute car position at all times, such as from a coded tape in the hoistway and a tape reader on the car, the proper travel direction to level the car will not be known. In this situation, the elevator car may be placed into a reset mode in which the car will be assigned an arbitrary, predetermined travel direction. The car may then proceed to the terminal floor in the selected direction, to reset the floor selector, or it may travel to the closest floor in the selected travel direction, if the car position for selector resetting purposes can be obtained from each floor. In any event, a landing error in which the car lands outside the landing zone disrupts normal elevator service until a selector reset mode has resynchronized the selector.

SUMMARY OF THE INVENTION

Briefly, the present invention is a new and improved elevator system, including both methods and apparatus, for correctly landing a car of an elevator system at a target floor, which stops outside its landing zone. The correct travel direction to properly level the car with the target floor is obtained from signals already present in most elevator systems, and by the addition of a memory device, such as a hardware or software counter. When the elevator car makes a run, its travel direction is stored in a suitable memory. As the car begins its run and travels through the hatch on the way to a target floor, a signal is provided each time the advanced car position is changed. This signal is used to increment the counter. In the prior art, the floor level control is not rendered effective until the car enters the slowdown phase of the run, in preparation for stopping at the target floor. In the present invention, the floor level signals provided by the floor level control are generated and utilized to decrement the counter.

On normal runs, the counter will return to zero as the car levels with the target floor, and the count on the counter and the stored travel direction are not utilized. When the car stops outside the landing zone of a target floor, this occurrence is detected by the landing or leveling controls, and instead of initiating a reset procedure to resynchronize the floor selector with actual car position, the proper travel direction to land the car at the original target floor is determined. The car is then run at leveling speed in the selected direction to the target floor, and the selector can be reset or synchronized using the address of the target floor.

If the elevator car undershoots the target floor, the count on the counter will not be returned to zero, i.e., it will be 001. If the car overshoots the target floor, the count will be zeroed as the car levels with and passes the target floor. Using the stored travel direction for the run, and the count on the counter, the correct travel direction can be determined. For example, when the stored travel direction is the up direction, the car travel direction will be set to the up direction when the count is non-zero, and it will be set to the down direction when it is zero. When the stored travel direction is the down travel direction, the car travel direction will be set to the down direction when the count is non-zero, and it will be set to the up direction when the count is zero.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

The invention is a new and improved elevator system, and method of operating an elevator system, of the type in which the position of the elevator car is maintained by a floor selector, such as by counting position pulses generated by each standard increment of car travel.

The new and improved system and methods are described by illustrating only those parts of an elevator system pertinent to the understanding of the invention with the remaining portions of a complete elevator system being incorporated by reference to issued patents assigned to the same assignee as the present application. Accordingly, U.S. Pat. Nos. 3,750,850; 3,804,209; 4,240,527; 3,902,572; and 4,019,606, are incorporated into the specification of the present application by reference. U.S. Pat. No. 3,750,850 sets forth a car controller, including a floor selector and speed pattern generator, U.S. Pat. No. 3,804,209 describes an interfacing arrangement for controlling and making assignments to a plurality of elevator cars under group supervisory control, which have the car controllers of U.S. Pat. No. 3,750,850, and U.S. Pat. No. 4,240,527 sets forth call answering strategy as well as computer control with a bidding arrangement for subprogram selection. U.S. Pat. Nos. 3,902,572 and 4,019,606 illustrate cam/switch, and optoelectronic arrangements, respectively, which may be used to detect when an elevator car is in the landing zone of a floor, and when it is substantially level with a floor. For purposes of example, it will be assumed that the elevator uses the cam/-switch arrangement of U.S. Pat. No. 3,902,572.

Figure 1:
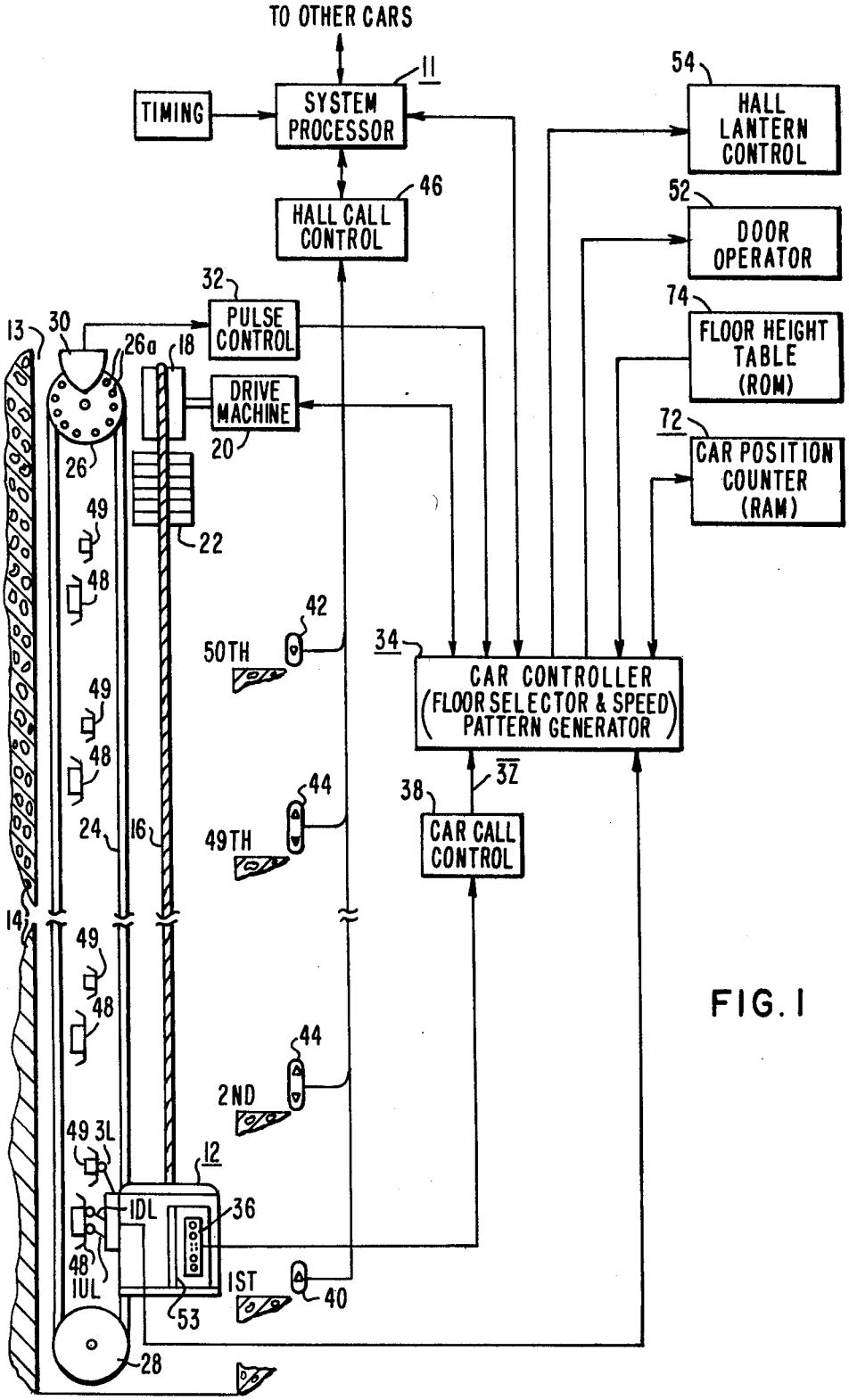
FIG. 1 is a schematic diagram of an elevator system which may be constructed and operated according to the teachings of the invention.

More specifically, FIG. 1 illustrates an elevator system 10 which may utilize the teachings of the inventon. Elevator system 10 includes one or more elevator cars, such as elevator car 12, the movement of which is controlled by a car controller 34, which in turn may be controlled by a system processor 11, when the system is under group supervisory control. The car controller 34 includes a floor selector and speed pattern generator, which are described in detail in incorporated U.S. Pat. No. 3,750,850. When the elevator cars are under group supervisory control, the car controller 34 of each car receives assignments from the system processor 11, as set forth in detail in incorporated U.S. Pat. Nos. 3,804,209 and 4,240,527. Since each of the cars of the bank of cars, and the controls therefore, are similar in construction and operation, only the controls for car 12 will be described in detail. Car 12 is mounted in a hatchway 13 for movement relative to a structure 14 having a plurality of landings, such as 50, with only the 1st, 2nd, 49th and 50th floors or landings being shown, in order to simplify the drawing. The car 12 is supported by a plurality of wire ropes 16 which are reeved over a traction sheave 18 mounted on the shaft of a drive machine 20. The drive machine 20 may be an AC system having an AC drive motor, or a DC system having a DC drive motor, such as used in the Ward-Leonard drive system, or in a solid state drive system. A counterweight 22 is connected to the other ends of the ropes 16. A governor rope 24, which is connected to the car 12, is reeved over a governor sheave 26 located above the highest point of travel of the car in the hatchway 13, and over a pulley 28 located at the bottom of the hatchway. A pick-up 30 is disposed to detect movement of the elevator car 12 through the effect of circumferentially spaced openings **26*a* in the governor sheave 26, or in a separate pulse wheel which is rotated in response to rotation of the governor sheave. The openings 26*a* are spaced to provide a pulse for each standard increment of travel of the car, such as a pulse for each 0.25 inch of car travel. Pick-up 30 may be of any suitable type, such as optical or magnetic. Pick-up 30 is connected to pulse control 32 which provides distance pulses for the car controller 34. Distance pulses may be developed in any other suitable manner, such as by a pick-up disposed on the elevator car 12** which cooperates with a coded tape disposed in the hatchway, or other regularly spaced indicia in the hatchway.

Car calls, as registered by pushbutton array 36 mounted in the car 12, are processed by car call control 38, and the resulting information is directed to the car controller 34.

Hall calls, as registered by pushbuttons mounted in the hallways, such as the up pushbutton 40 located at the first floor, the down pushbutton 42 located at the 50th floor, and the up and down pushbuttons 44 located at the second and other intermediate floors, are processed in hall call control 46. The resulting processed hall call information is directed to the system processor 11. The system processor 11 allocates the hall calls to the cars according to a predetermined strategy, to effect efficient service for the various floors of the building and effective use of the cars. When the system processor 11 is not operational, the hall calls are directed to the car controllers of all of the cars.

The car controller 34 processes the distance pulses from the pulse detector 32 to develop information concerning the position of the car in the hatchway 13, to the resolution of the standard increment. The distance pulses are also utilized by the speed pattern generator, to generate a speed reference signal for the drive machine 20.

The car controller 34 through its floor selector keeps track of the position of the car 12, and the calls for service for the car. It also provides the signals for starting and stopping the elevator car to serve calls for elevator service. The car controller 34 also provides signals for controlling such auxiliary devices as the door operator 52, which controls the door 53 on the car 12, the hall lantern 54, and it controls the resetting of the car call and hall call controls when a car or hall call has been serviced.

Landing and leveling of the car 12 at each floor may be accomplished by leveling switches 1DL and 1UL on the car, which cooperate with leveling cams 48 at each floor, as described in detail in incorporated U.S. Pat. No. 3,902,572; or by a hatch transducer system which utilizes inductor plates disposed at each landing, and a transformer disposed on the car 12, as described in incorporated U.S. Pat. No. 4,019,606. A switch 3L on the car and cams 49 in the hoistway may be used to determine when the elevator car is a predetermined distance from a floor, such as ten inches. Alternatively, the optoelectronic arrangement of U.S. Pat. No. 4,019,606 may be used to provide such position signals.

Figure 3:
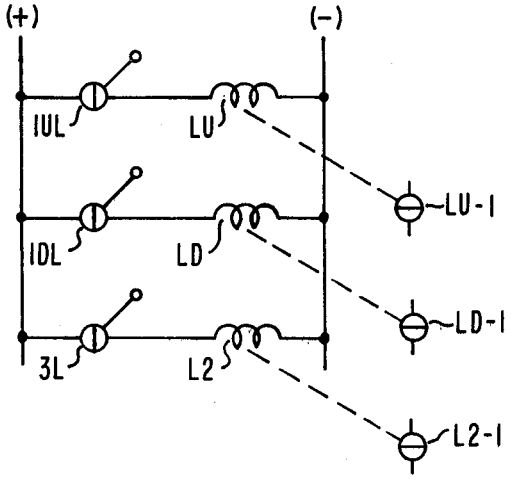
FIG. 3 is a schematic diagram, illustrating the electrical connection of certain switches shown in FIG. 1.

FIG. 3 is a schematic diagram illustrating how switches 1UL, 1DL and 3L may be connected to control the operative state or condition of electromagnetic relays LU, LD and L2, respectively.

When the car is within about ±0.25 inch of floor level, both switches 1UL and 1DL will be on a cam 48, and relays LU and LD will both be deenergized. If the car 12 moves up or down from the level position, switch 1UL or switch 1DL will come off the cam and pick up relay LU or LD, respectively, to initiate up or down releveling. A zone of ±2 to 3 inches is provided about each floor level, in which at least one of the switches 1DL or 1UL is on a cam, which zone thus defines the landing and releveling zone.

Figure 4:
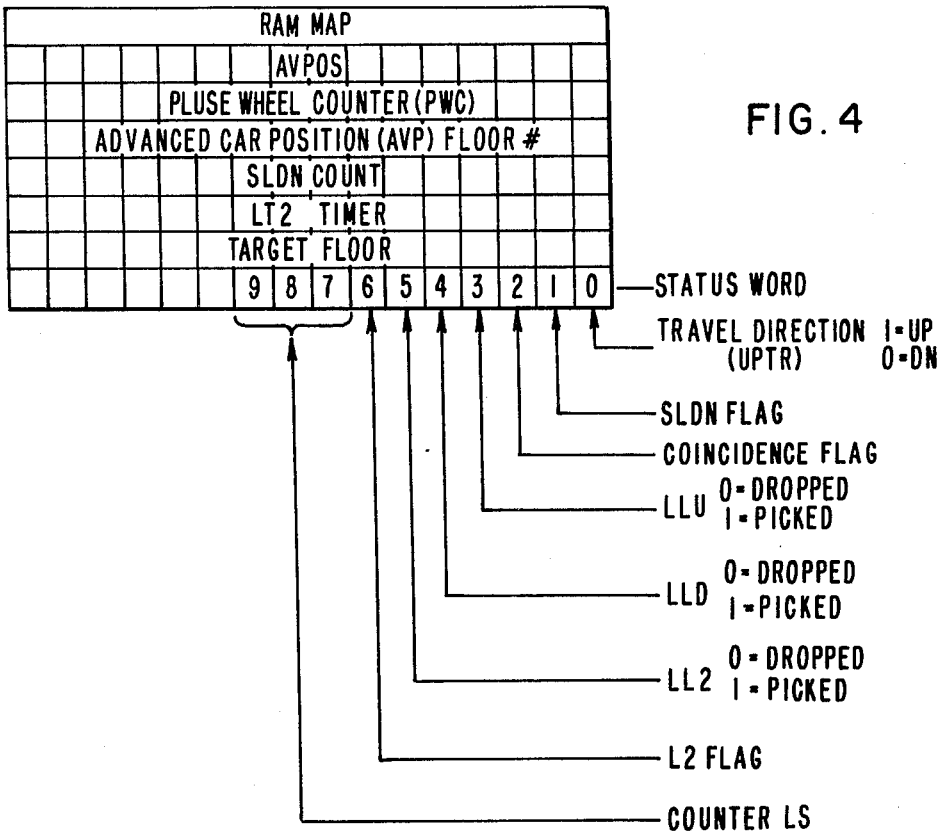
FIG. 4 is a RAM map illustrating the storage locations of certain car, system and program related addresses, counters, timers, signals and flags.

Switch 3L controls relay L2 which starts a software timer LT2 shown in FIG. 4 when it drops out, about 10 inches from the target floor. The LT2 timer is set to a value which represents the normal time for the elevator car to move from the predetermined point, such as the 10 inch point, to the landing zone, or to the target floor level. When the LT2 timer times out, this fact is used to initate a leveling program, if the elevator car is not within ±0.25 inch of floor level, as will be hereinafter described.

Figure 2:
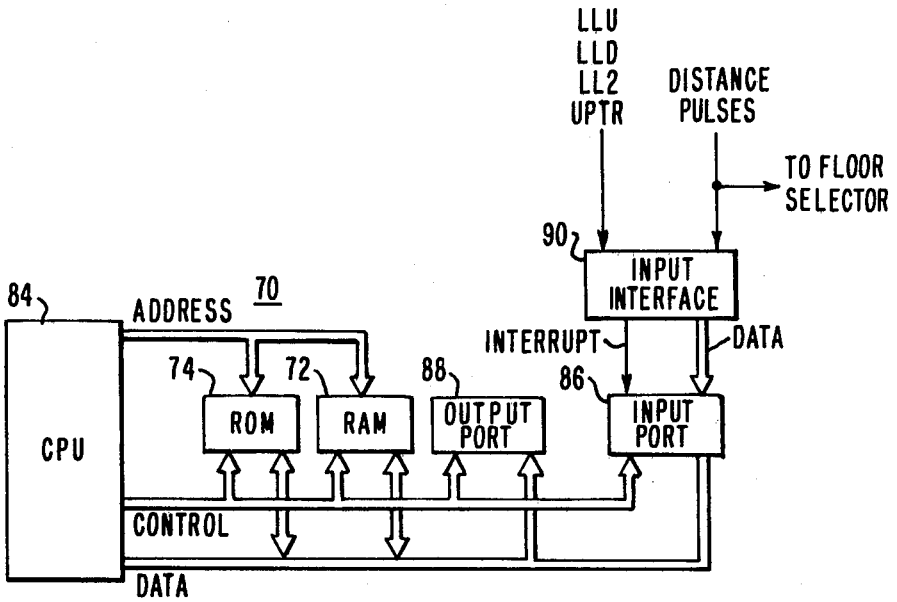
FIG. 2 illustrates a microprocessor which may be part of the car controller shown in FIG. 1.

The actual car position may be maintained by a solid state, binary up/down counter, and/or the car controller 34 may include a digital computer, such as a microprocessor 70, shown in FIG. 2. The microprocessor 70 may maintain a counter in RAM 72, for maintaining the car position, which counter will be referred to as pulse wheel counter PWC. FIG. 4 is a RAM map which sets forth suitable formats for certain data which may be stored in RAM 72, including the pulse wheel counter PWC. PWC may be auxiliary to a counter in the floor selector of the car controller, or, if the functions of the car controller are all implemented by a microprocessor, PWC may be the primary car position counter.

Figure 5:
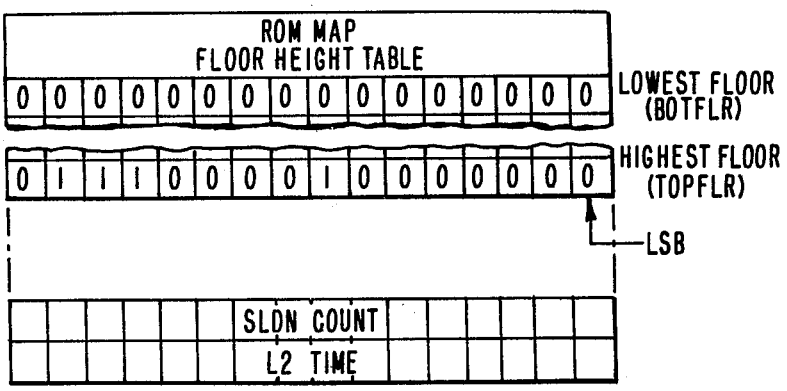
FIG. 5 is a ROM map illustrating a floor height table which provides the floor height address for each floor of the building: the normal slowdown count representative of the slowdown distance for stopping a car at a target floor from contract speed, is also stored in ROM.

Each floor of the building has a binary address corresponding to its height or distance from the lowest floor of the building, with the binary address being in the terms of the standard increment. The first floor address may be all zeros. If the 50th floor is 600 feet above the first floor, its binary address, when a pulse is generated for each 0.25 inch of car travel, would be 0111 0000 1000 0000, the binary representation for 28,800. The binary address for each floor is maintained in a floor height table stored in ROM 74, with FIG. 5 being a ROM map which sets forth a suitable format for the floor height table. The floor height table in ROM 74 may be the same one used by the floor selector of the car controller 34 in formulating its decisions, such as deceleration signals, for stopping the elevator car at the proper floor, or it may be auxiliary to another floor height table, as desired. ROM 74 is also programmed to store a constant, referred to as the SLDN count. The SLDN count is the binary number which represents the normal slowdown distance, in terms of the standard increment, required to decelerate the elevator car from contract or rated speed according to a predetermined decleration schedule, and to stop the car level with the target floor. This count, added to or subtracted from, the pulse wheel count, will give the advanced car position AVPOS for the up and down travel directions, respectively, in terms of the standard increment. The advanced car position AVP, also stored in RAM 72, is in terms of the floor number, rather than in terms of the standard increment.

Referring now to FIG. 2, microprocessor 70 includes a central processing unit or CPU84, an input port 86, an output port 88, and the memories 72 and 74, which were hereinbefore referred to. An input interface 90, which may include a scratchpad memory, receives the distance pulses from the pulse control 32, and the travel direction signal UPTR, which is a logic one when the elevator car is set up for travel, and a logic zero when the car is set for down travel.

Microprocessor 70 also receives signals LLU, LLD and LL2 representative of the state of relays LU, LD and L2, respectively, which signals may be generated by a logic level interface responsive to contacts LU-1, LD-1 and L2-1, respectively. Signals LLU, LLD, and LL2 are a logic zero when the associated relay is dropped out, and a logic one when the associated relay is picked up. As shown in the RAM map of FIG. 4, the travel direction signal UPTR may be stored at bit position zero of a 16 bit status word STW1. Bit positions 1, 2 and 6 store flags used in the program, bit positions 3, 4 and 5 store signals LLU, LLD and LL2, respectively, and bit positions 7, 8 and 9 are used to perform the function of a software counter LS.

Figure 6A:
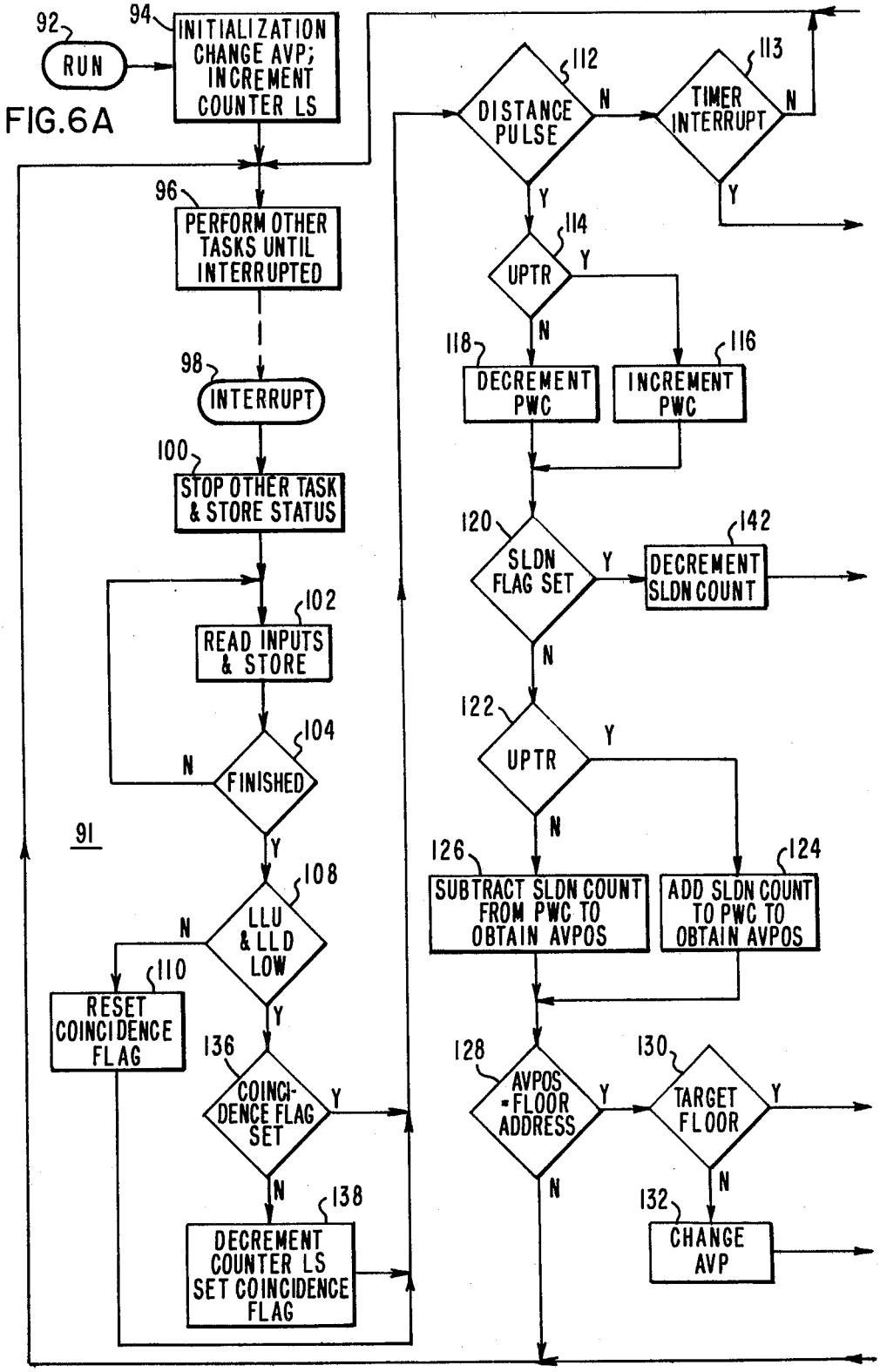
FIGS. 6A and 6B may be assembled to provide a flow chart of a program run by the microprocessor shown in FIG. 2.
Figure 6B:
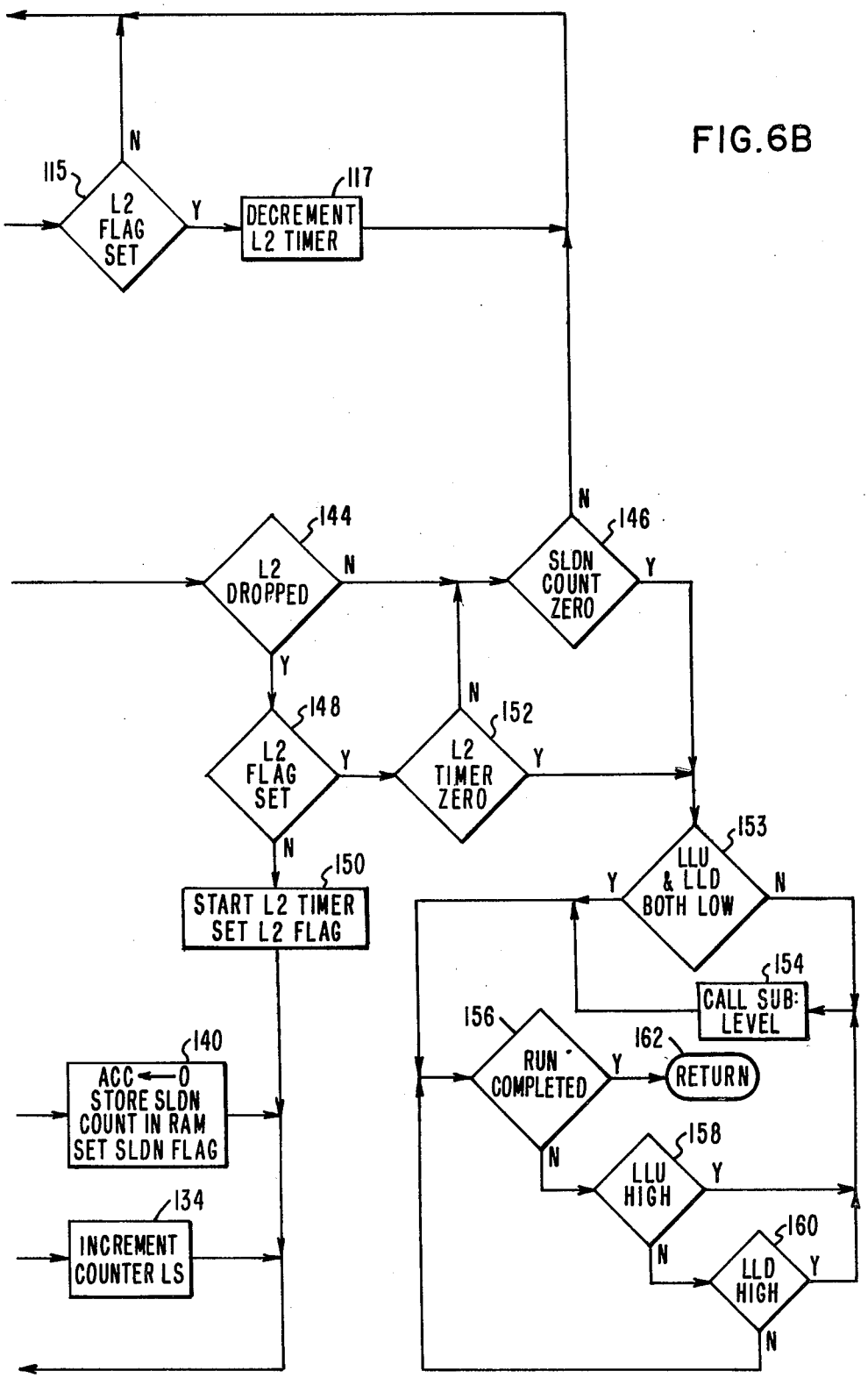

FIGS. 6A and 6B may be assembled to provide a flow chart of a program 91 which may be stored in ROM 74 and run by CPU 84. Program 91 is entered at 92 and it is initialized at 94 when the elevator car 12 is to start a run. The intitalization step, for example, changes the advanced car position to the next floor ahead of the car's intended travel direction, and it increments counter LS. Counter LS, which in this example is a software counter which maintains a binary count in RAM 72, is incremented each time the advanced car position changes to another floor. Thus, counter LS is incremented from 000 to 001. The initialization step also resets program flags and timers, and it clears temporary word locations. The information in RAM 72 is maintained, even during shutdown of the elevator car 12, by a suitable battery or auxiliary power supply, which supplies power to certain circuits of the microprocessor 70 when the main power supply is turned off, or interrupted. Step 96 then goes on to perform other tasks, until the input interface 91 shown in FIG. 2 generates an interrupt signal. An interrupt will be generated when each distance pulse is received.

When an interrupt is generated, indicated by interrupt line 98 in FIG. 2, step 100 stops the task it is processing and stores its status for later return, and step 102 reads the inputs applied to input port 86 by interface 90. If all inputs cannot be transferred at one time, step 104 checks to determine if all of the information has been transferred, and if not, the program returns to step 102 to transfer the next batch of data. When step 104 finds all data has been read and stored, step 108 determines if the elevator car is passing a floor level. According to a preferred embodiment of the invention, this function is performed by allowing the floor leveling circuits to remain functional during a run, at least from the viewpoint of allowing them to provide a signal when the car is level with a floor during a run. Normally, the floor leveling circuits are rendered effective only after the advanced car position corresponds to a floor at which the car should stop for some reason, such as to service a car or hall call, or to stop at a terminal or parking floor. By allowing the leveling circuits to remain active, a floor level signal is provided as the car passes each floor. If the car speed does not exceed about 2000 FPM, the floor level signal will persist long enough to be recognized by the program. If there is a possibility that the floor level signal may be missed, it may be stored when it is generated, until it is recognized by the program, such as by setting a predetermined memory. After the stored floor level signal is recognized, the memory would then be reset by the program. In the exemplary embodiment set forth in FIG. 1, the floor level signal is produced when both leveling relays LU and LD are dropped out at the same time. Thus, the program at step 108 may simply inquire as to whether or not both logic signals LLU and LLD, stored at bit locations 3 and 4, respectively of status word STW1, are both low. During a run, it would also be suitable to simply check to see if just a predetermined one of the two signals is low, which would then provide a signal of longer duration and would not have to be stored longer than its normal persistance time. At this point in the description of the program, it will be assumed that the car is not in the process of passing another floor, and the program advances to step 110 which resets a coincidence flag located at bit position two of status word STW1. The coincidence flag makes sure that each floor level will be only counted once as the elevator car is passing the floor. Step 112 then checks to see if the interrupt was due to a new distance pulse. If not, and other situations can generate an interrupt, such as a time interrupt, the program would go into a branch to determine the cause of the interrupt and to take appropriate action. For example, step 112 may proceed to step 113 which checks to see if it was a timer interrupt, and if so, it would check to see if there are any active timers which require updating. As will be hereinafter explained, step 115 checks an L2 flag, which, if set, indicates an LT2 timer is active, and step 117 would decrement the LT2 timer, if active.

Step 114 checks the travel direction signal UPTR stored at bit zero of the status word STW1. If the travel direction is up travel, step 116 increments the pulse wheel counter PWC, and if it is the down travel direction, step 118 decrements the pulse wheel counter PWC. The count on counter PWC represents the absolute position of the elevator car in the hatch, in terms of the standard increment.

Step 120 checks a slowdown flag SLDN, to see if the car is in the slowdown phase of the run. At this point in the description of the program, it will be assumed that it is not in the slowdown phase. Step 122 checks the travel direction, with step 124 determining the advanced car position AVPOS for up travel, and step 126 doing the same for down travel. This is accomplished by adding the SLDN count to the pulse wheel count during up travel, and by subtracting it from the pulse wheel count during down travel. The result, referred to as AVPOS, is the advanced car position in terms of the standard increment, and it is compared with the floor addresses in step 128, to see if the advanced car position has reached a floor level. The count AVPOS may be compared with all floor addresses in the floor height table, or, the program may keep track of the next floor ahead, and compare the count AVPOS with the address of this next floor. If AVPOS does not match the address of a floor, the program returns to step 96 to await the next distance pulse. Eventually, step 128 will find that the advanced car position AVPOS matches the address of the floor ahead, and the program then advances to step 130 to determine if the elevator car should stop at this floor. If the car is under group supervisory control, a target floor address of the next floor at which the car should stop may be given to the car, which is stored in RAM 72, as shown in FIG. 4. If the car is not under group control, step 130 would check to see if the car has a car call for this floor, if the floor has a hall call for the car's travel direction, or if the floor is a terminal floor. If step 130 finds no reason for the car to stop at the AVPOS floor, step 132 changes the AVP to the next floor ahead and step 134 increments counter LS. Thus, the binary count on counter LS is now 010, having previously been incremented in step 94.

The floor level associated with AVPOS when it matches a floor address in step 128 will soon be passed by the elevator car, and step 108 will then find that signals LLU and LLD are both low, i.e., when the car is passing through a zone of about ±0.25 inch about the floor level. Step 136 checks to see if this "floor level" occurrence has already been noted, by checking to see if the coincidence flag stored at bit 2 of STW1 has been set. Since at this point in the description it has not been set, step 136 advances to step 138 which decrements counter LS, which in the example will change it from 010 to 001, and step 138 also sets the coincidence flag. If signals LLU and LLD are still low when the next distance pulse is received, step 136 will find the coincidence flag set, and the program will bypass step 138. When step 108 finds that the signals LLU and LLD are no longer both low, step 110 resets the coincidence flag.

From step 138, the program returns to 96, and the program steps hereinbefore described to this point are repeated for each new distance pulse, until step 130 finds that the AVPOS count is the address of the target floor, or a floor at which the elevator car should stop. Step 140 then sets a signal ACC to zero, and sends this signal to the speed pattern generator as part of an output or command word, to initiate the slowdown phase of the run. Step 136 also stores the SLDN count in RAM 72, obtaining it from ROM 74, and it sets the SLDN flag, which is bit one of STW1, to indicate the fact that the car is now in the slowdown phase. The program then returns to step 96 to await the next distance pulse.

When the next distance pulse occurs, step 120 will now find that the SLDN flag is set, and steps 122 through 134 are bypassed, with the program branching to step 142 which decrements the SLDN count. This count may be used to develop the slowdown speed pattern, or a separate counter may be used, as desired.

Step 144 checks for the arrival of the car at a predetermined point relative to the floor at which the car is going to stop, such as the 10 inch point, by checking to see if relay L2 has dropped. This may be done by checking the logic level of signal LL2 at bit position 6 of STW1. At this point in time, the car has not yet reached the 10 inch point, and step 146 checks to see if the SLDN count has been decremented to zero. At this point in time, it should not have been decremented to zero, and the program returns to step 96.

When the 10 inch point is reached, and step 144 finds signal LL2 at the a logic zero level, step 148 checks to see if the LT2 timer has been actuated by checking the L2 flag, located at bit position 6 of STW1. Since the L2 flag has not been set, step 150 loads the LT2 time into a storage location in RAM 72, as indicated in FIG. 4, and step 150 also sets the L2 flag to indicate the LT2 timer is active. The L2 time stored in RAM 72 may be found in ROM 74. The LT2 timer is maintained by steps 113, 115 and 117. The LT2 time value is determined by the normal length of time for the elevator car to decelerate from the 10 inch point to the landing zone, with the expiration of this time starting a landing and leveling mode. When the program reaches step 148 on the next distance pulse, it will find the L2 flag set and the program will branch to step 152 to check the LT2 timer. When the LT2 time expires, or should the SLDN count for some reason reach zero before the LT2 timer is decremented to zero, the program checks to see if the car is at floor level in step 153. If the car is at floor level, or has passed through the leveling zone, step 108 would previously note this fact and step 138 would decrement counter LS to zero. If the car has not reached floor level, the LS count will still be 001. If signals LLU and LLD are not both low, step 154 calls a subroutine LEVEL, which starts a leveling phase of the run. Subroutine LEVEL is set forth in FIG. 7, and will be hereinafter described. When the subroutine has completed its program, the elevator car should be at floor level, and step 156 checks to see if the run has been completed. If step 153 finds the car to be at floor level, it would also advance to step 156. The run may include the time the car is stopped with its doors opened, with the run being complete when the door non-interference time expires, or when the doors close, or when a "start" signal has been received, or the like. While the run continues, stretch-of-rope releveling is effective via steps 158 and 160, which steps check signals LLU and LLD to detect if either goes to a logic one. If one of the switches 1UL or 1DL comes off of a cam 48, signal LLU or signal LLD will go high, and subroutine LEVEL would be called to relevel the car. When step 156 finds the run has been completed, the program returns to a priority executive, or other supervisory program, exiting at terminal 162.

Figure 7:
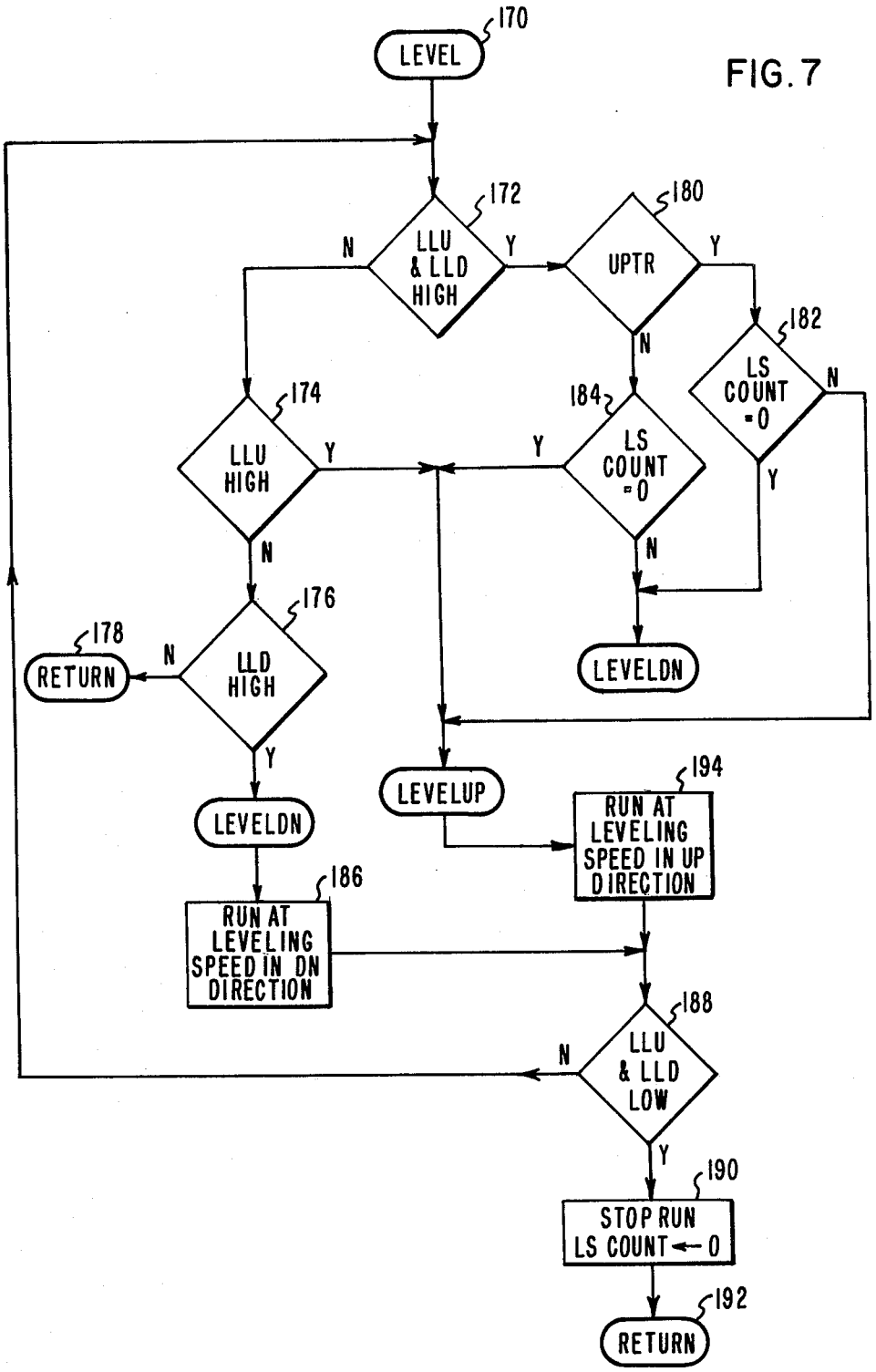
FIG. 7 is a flowchart of a subprogram which is called by the program shown in FIGS. 6A and 6B when the elevator car should be at the target floor, but is not at floor level.

FIG. 7 sets forth a program which implements the subroutine LEVEL shown in block 154 of FIG. 6B. The subroutine is entered at 170 and step 172 checks to see if signals LLU and LLD are both high. If so, the car has stopped outside the landing zone. At this point in the description it will be assumed that the car stopped within the landing zone, but not precisely at floor level. Thus, one of the signals LLU or LLD will be low, and step 174 checks to see if signal LLU is high. If it is, it means the car is below floor level, and the program advances to terminal LEVELUP, which starts an up leveling mode. If step 174 finds signal LLU low, step 176 checks to see if signal LLD is high. If it is, the program goes to terminal LEVELDN, which starts a down leveling mode. If step 176 finds signal LLD low, the car is now at floor level, and the subroutine returns to step 156 in FIG. 6B via terminal 178.

If step 172 finds both signals LLU and LLD high, the car is stopped outside the landing zone, and the program advances to step 180 which checks the stored travel direction signal UPTR, located at bit zero of STW1. If the stored travel direction is the UP direction, step 182 checks the LS count stored in RAM 72. If the LS count is zero, it means the UP traveling car passed the floor level, and step 182 proceeds to the LEVELDN terminal. If the count is not zero, it means the UP traveling car did not reach floor level, and step 182 proceeds to the LEVELUP terminal.

If step 180 finds the travel direction of the run was the down direction, step 184 checks the LS count. If the count is zero, it means the down traveling car passed the floor level of the target floor, and step 184 proceeds to the LEVELUP terminal. If the count is not zero, it means the down traveling car did not reach the level of the target floor, and step 184 proceeds to the LEVELDN terminal.

The down leveling function, which starts at terminal LEVELDN, includes a step 186, which sets the car travel direction to the down direction, and it also starts the car running at leveling speed. The program then advances to step 188 which determines if the car is at floor level, by checking signals LLU and LLD stored in RAM 72. If the car is not at floor level, the program returns to step 172 and goes into a loop, repeating the appropriate steps until step 188 finds the car at floor level, at which time step 190 prepares a command which stops the car, and it also zeros the LS count. The subroutine then returns to the main program, exiting at terminal 192.

The up leveling function, which starts at terminal LEVELUP, is similar to that described for the down leveling function, except for travel direction. Step 194 prepares a command word which sets the elevator car for the up travel direction, and it also starts the elevator car in the up travel direction at leveling speed. When step 188 finds the car to be at floor level, step 190 stops the car and the program exits at terminal 192.

Figure 8:
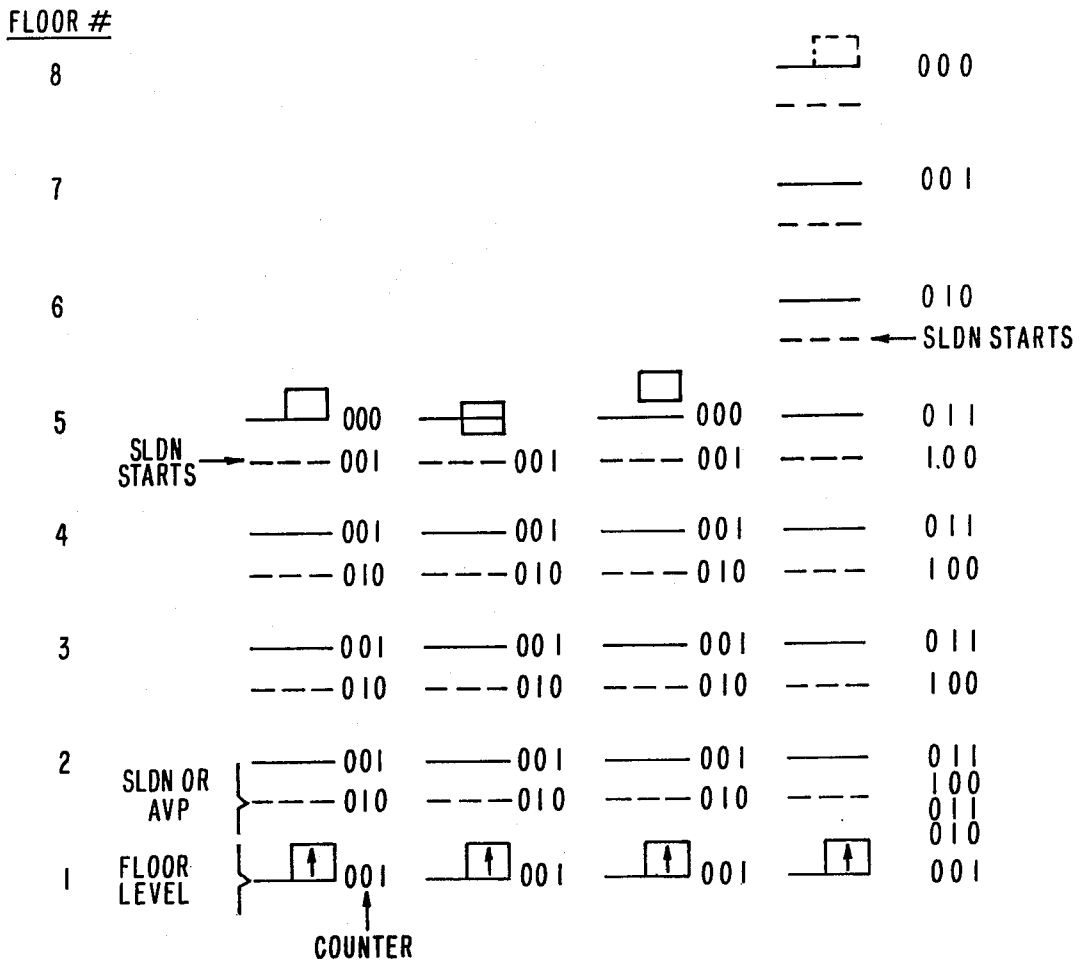
FIG. 8 is a diagrammatic representation of several examples of elevator systems operating according to the teachings of the invention, which sets forth the count on a counter as it is maintained during a run, according to the teachings of the invention.

FIG. 8 is a diagrammatic representation which illustrates the count on the LS counter in a first example for an elevator system having a car speed and building floor height dimensions such that at contract speed the car's AVP never drives the binary count above 010. A second example illustrates a higher speed elevator system in which the car's AVP is several floors ahead of the actual position of the elevator car, at contract speed, driving the binary LS count to 100.

In the first example shown in FIG. 8, a normal landing is illustrated in the first column, undershooting the landing is illustrated in the second column, and overshooting the landing in the third column. It will be noted that the AVP is advanced at the very start of the run, to the next floor in the travel direction of the car, and thus the binary LS count is incremented to 001 at the starting floor, which is floor number one in the example. When the car reaches the broken line indicated below the level of the second floor, a decision is made as to whether or not the car is to stop at the second floor. If so, the AVP will not be advanced, and the LS count would not be incremented. If the decision is made not to stop the car, the LS count is incremented to 010 at the broken line position. When the car reaches the level of the second floor, the LS count is decremented to 001. The LS count continues to change between 010 and 001, until the slowdown point for the target floor is reached, which is the fifth floor in the example. The LS count is not incremented at the slowdown point, and the arrival of the car at floor level zeros the count. If the car does not reach floor level, as illustrated in column 2, the count will remain 001. If the car overshoots the fifth floor, the count will be zeroed when it reaches floor level.

In the second example, the elevator system is a higher speed system, with the car making a run from the first to the eighth floor. The advanced car position rapidly advances out ahead of the car, incrementing the LS count for each new floor position, reaching a binary count of 100 before the arrival of the car at the level of the first floor provides a signal which decrements the binary count to 011. The LS count then changes back and forth between 100 and 011 until the slowdown point is reached for the eighth floor. As illustrated in the example, this point is just below the sixth floor. The 011 count at the slowdown point is not incremented, and the count is decremented as the car reaches the level of each floor, going to 010 at the sixth floor, to 001 at the seventh floor, and to 000, if it reaches the level of the eighth floor. Thus, the invention is applicable to any contract speed and floor height combination.

We claim as our invention:

1. An elevator system, comprising:

a building having a plurality of floors, an elevator car mounted for movement in the building to serve said floors, said elevator car having an advanced position while moving which corresponds to the closest floor ahead at which it can make a normal stop, means storing the travel direction of the run, means providing a first signal, with said first signal being an advanced car position signal which is only provided each time the advanced car position changes from one floor to another floor during a run, means providing a second signal, with said second signal being a floor level signal which is only provided each time the elevator car is level with a floor during the run, counter means responsive to said first and second signals, with said counter means being incremented by the first signals and decremented by the second signals, means defining a landing zone adjacent each floor, detector means for detecting when said elevator car stops outside said landing zone, and direction means responsive to said detector means, to the count of said counter means, and to the stored travel direction, for setting the car travel direction to cause the elevator car to run in the direction of the target floor when it stops outside its landing zone.

2. The elevator system of claim 1 wherein the counter means is a binary counter which starts at zero, and wherein the direction means sets the car travel direction (a) to up when the stored travel direction is up and the binary count is non-zero, (b) to down when the stored travel direction is up and the count is zero, (c) to up when the stored travel direction is down and the count is zero, and (d) to down when the stored travel direction is down and the count is non-zero.

3. The elevator system of claim 1 including means for running the elevator car in the direction selected by the direction means, and means for stopping the elevator car when the second signal is provided.

4. The elevator system of claim 1 wherein the means defining the landing zone includes a cam associated with each floor and first and second switches on the elevator car, which switches are actuated by said cams, with the landing zone including that zone adjacent each floor over which at least one of said switches is actuated by the associated floor cam, and wherein the means providing the second signal is responsive to at least one of said first and second switches being actuated by a cam.

5. The elevator system of claim 1 including pulse means for generating a pulse for each predetermined standard increment of car movement, means responsive to said pulse means for maintaining the exact car location as a digital count, slowdown means which stores a count representative of the normal slowdown distance of the elevator car, and floor address means which stores the address of each floor in terms of a digital count, and means which stores the floor address of the target floor, with the means which provides the first signal providing the first signal (a) when the car is traveling downward and the count representing the exact car location minus the slowdown count equals the floor address of a non-target floor, and (b) when the car is traveling upward and the count representing the exact car location plus the slowdown count equals the floor address of a non-target floor.

6. A method of determining the proper travel direction of an elevator car to cause it to run to a target floor when it stops outside the landing zone of the target floor, comprising the steps of:

storing the travel direction of the elevator car during a run, maintaining a count which starts at a predetermined value, incrementing the count each time the advanced car position changes from one floor to another floor during the run, decrementing the count each time the elevator car is level with a floor during the run, detecting when the car stops outside the landing zone of the target floor, determining the proper travel direction in which the car stopped outside the landing zone should run to travel to the target floor, using the stored travel direction and the count, and running the car in the determined travel direction until the car is level with the target floor.

7. The method of claim 6 wherein the step of determining the travel direction includes the steps of:

(a) setting the car travel direction to up when the stored travel direction is up and the count is non-zero, (b) setting the car travel direction to down when the stored travel direction is up and the count is zero, (c) setting the car travel direction to up when the stored travel direction is down and the count is zero, and (d) setting the car travel direction to down when the stored travel direction is down and the count is non-zero.

* * * * *